United States Patent [19]

Posson

[11] 4,220,087

[45] Sep. 2, 1980

[54] LINEAR IGNITION FUSE

[75] Inventor: Philip L. Posson, Suisun, Calif.

[73] Assignee: Explosive Technology, Inc., Fairfield, Calif.

[21] Appl. No.: 962,180

[22] Filed: Nov. 20, 1978

[51] Int. Cl.[2] ..... C06C 5/00; F42B 3/10

[52] U.S. Cl. ..... 102/27 R; 102/90

[58] Field of Search ..... 102/27 R, 90

[56] References Cited

U.S. PATENT DOCUMENTS

| | | | |
|---|---|---|---|
| 548,022 | 10/1895 | Watson | 102/27 R |
| 2,239,052 | 4/1941 | Pearsall et al. | 102/27 R |
| 3,027,839 | 4/1962 | Grandy et al. | 102/27 R |
| 3,320,881 | 5/1967 | Brett et al. | 102/27 R |
| 3,667,391 | 6/1972 | Amiable et al. | 102/27 R |
| 3,712,222 | 1/1973 | Richardson et al. | 102/27 R |
| 3,730,096 | 5/1973 | Prior | 102/27 R |
| 3,874,293 | 4/1975 | Seligmann | 102/27 R |
| 3,881,420 | 5/1975 | Smith et al. | 102/27 R |

*Primary Examiner*—Edward A. Miller

*Attorney, Agent, or Firm*—Flehr, Hohbach, Test, Albritton & Herbert

[57] ABSTRACT

Non-detonative linear ignitor fuse for substantially instantaneous ignition of materials distributed along the exterior length of the fuse. The fuse includes a core of non-detonative, ignitive material encased within an imperforate frangible sheath which is ruptured by combustion of the core material. A gas channel extends longitudinally of the fuse adjacent to the ignitive material. As the ignitive reaction travels along the length of the fuse, the sheath is shattered, and incandescent reaction products are spewed from the fuse in a generally radial direction.

13 Claims, 10 Drawing Figures

LINEAR IGNITION FUSE

BACKGROUND OF THE INVENTION

This invention pretains generally to ignition fuses and more particularly to a non-detonative linear ignition fuse suitable for use in gas generators and other applications requiring substantially instantaneous ignition of a material distributed along the exterior length of the fuse.

Linear ignition fuses of the prior art have had a number of limitations and disadvantages. One type of prior linear ignition fuse consists of a core of high explosive and particulate fuel mixture in a ductile metallic sheath, as for example described in U.S. Pat. No. 3,320,882. The high explosive employed may be of the primary or secondary type. Primary high explosive-sensitized linear ignition fuses may be initiated by a flame source, such as percussion primers, electric squibs and the like. However, this type of ignition fuse is hazardous and expensive to manufacture, presents a mass detonation hazard in storage and can produce toxic products in use. Linear ignition fuses employing secondary high explosives require detonative initiation and are subject to essentially the same manufacturing, storage and toxicity disadvantages as fuses using primary explosives. A second type of linear ignition fuse of the prior art employs a filling of pyrotechnic mixture and one such fuse is the so-called "artillery tube" ignitor. This fuse comprises a perforated metallic tube with a frangible inner liner, confining a material such a black powder. Such an ignitor may be flame-initiated. However, it is inflexible, relatively heavy, expensive and hazardous to manufacture. It also exhibits an undesirably slow propagation velocity. For example, a pyrotechnic type of ignitor might have a propagation velocity of 400 meters per second, compared to a high explosive-type propagation velocity of 4000–8000 meters per second.

SUMMARY AND OBJECTS OF THE INVENTION

The invention provides a linear ignitor fuse having a core of non-detonating, ignitive material comprising a mixture of particulate fuel, oxidant and a binder encased within a frangible sheath, with a longitudinally extending gas channel adjacent to the ignitive material of the core. This fuse provides a non-detonative radial ignitive reaction which is transmitted rapidly without the disadvantages of prior art devices.

It is in general an object of the invention to provide a new and improved linear ignition fuse.

Another object of the invention is to provide an ignitor fuse of the above character which is less hazardous to manufacture, store and use than fuses of the prior art.

Another object of the invention is to provide a high velocity radial ignition fuse which does not require detonative initiation.

Additional objects and features of the invention will be apparent from the following description in which the preferred embodiments are set forth in conjunction with the accompanying drawings.

DESCRIPTION OF THE PREFERRED EMBODIMENTS

Figure 1:
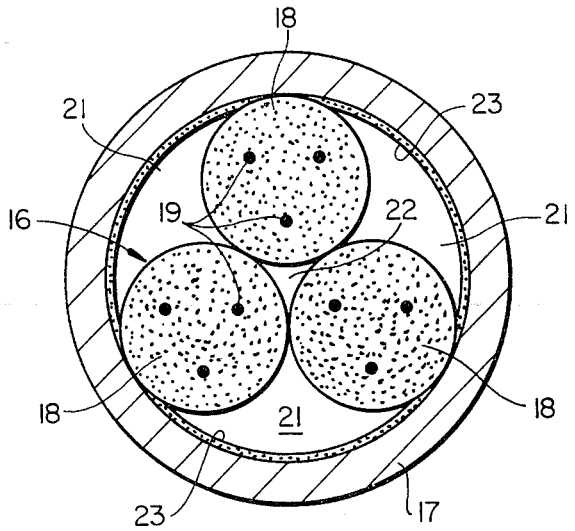
FIGS. 1–10 are enlarged transverse sectional views of linear ignitor fuses according to the invention.

As illustrated in FIG. 1, the fuse includes an elongated core 16 encased within an imperforate tubular sheath 17. The core comprises three strands 18, each of which includes a plurality of supporting strands 19 coated with a non-detonative, ignitive mixture of powdered fuel, oxidant and a suitable binder. Strands 19 are fabricated of a material such as glass fibers, metal or a polymeric material. The fuel is one which has a high heat of combustion, preferably greater than 2000 calories per gram. Suitable powdered fuels include aluminum, titanium, magnesium, a 50/50 magnesium-/aluminum alloy, amorphous boron, 70/30 zirconium/-nickel alloy or calcium silicide. Suitable oxidants include potassium perchlorate, ammonium perchlorate, or other nitrates, chromates, polychromates or perchlorates of alkali or alkaline earth metals, ammonia, or organic bases.

A wide variety of polymeric binders with suitable properties are available, and the binder is chosen to provide compatability with the fuel and oxidant combination, as well as to provide the desired adhesion, mechanical strength, and storage capability.

The ingredients enumerated here are only typical, and as will be recognized by those skilled in the art, the ultimate choice of materials is based upon the best solution to the particular design criteria to be satisfied.

Sheath 17 is fabricated of a frangible material such as plastic, metal, ceramic, or a composite material such as a synthetic resin containing high strength fibers. The area bounded by the sheath is larger than the transverse sectional area of the core, and the spaces 21 between the core strands and the sheath form gas channels which are filled with air or other gas. An additional gas channel 22 is formed at the center of the core. An adherent powdery ignition layer 23 is formed on a majority of the interior surface of the sheath. This adherent layer 23 may be composed of the same materials as strands (18), with an optionally reduced (or zero) content of binder and solvent. Layer 23 may also contain 10–90% by weight of a compound of lower exothermic decomposition termperature than that of the main strand mass 18. Suitable compounds to this end include organic polynitrocompounds (such as 2, 4, 6 trinitrotoluene, 2,2′, 4,4′, 6,6′ hexanitro stilbene, tetra nitrocarbozole, ammonium picrate, and the like), organic nitramines (cyclotrimethylene trinitramine, cyclo tetramethylene tetranitramine, nitroguanidine, ethylenedinitramine), organic oxyacid esters such as guanidine perchlorate, guanidine nitrate, ethylenediamine dinitrate, cellulose nitrate, or pentaerythritol tetranitrate, and tetrazoles, such as polymethylvinyl tetrazole. In this and in the other embodiments disclosed, core 16 is of substantially uniform cross-section, and the gas channels extend continuously throughout the length of the fuse. The ends of the sheath can be left open, or they can be sealed or plugged by suitable means, not shown.

In a preferred method of manufacture, the supporting strands are coated with the mixture of powdered fuel, oxidant, modifiers and binder with solvents in an extrusion process, and the mixture is allowed to dry. Sheath 17 is also formed by extrusion, and layer 23 is applied to the inner surface of the sheath and the core is positioned in the sheath during the extrusion process.

EXAMPLE 1

A mixture comprising on the order of 22.34 percent by weight fine flake aluminum powder, 36.17 percent ammonium perchlorate and 41.49 percent potassium perchlorate was blended and passed through a 50 mesh screen and then through a 100 mesh screen. A binder solution was prepared from 83 cc. of solvent, comprising a 1:1 mixture of anhydrous ethyl alcohol and acetone, and 11.36 grams of Hycar 2671 polyethyl acrylate emulsion containing 53 percent solids. The powder mixture and binder solution were blended to form a smooth, heavy paste. The paste was deaerated and passed through a 60 mesh screen to homogenize the mixture. The mixture was pressure-extruded onto three strands of glass fiber having a weight on the order of 43 milligrams per foot. After vacuum drying to remove the solvent, the core material was cut into three strands which were placed in a Kynar* polyvinylidene fluoride polymer tube having an outside diameter of 0.129 inch and an inside diameter of 0.087 inch. This fuse has a core load on the order of 0.6 gram per foot.

*Pennwalt Trademark

EXAMPLE 2

A fuse was prepared as in Example 1, with following changes: the mixture of powdered metal and oxidant included 24 percent flake aluminum, 69 per potassium perchlorate, and 7 percent poly(2-methyl vinyl tetrazole). One percent Silanox** was added to the mixture, and acetonitrile was used as the solvent for the binder. After extrusion of the mixture onto a glass fiber support and evaporation of the solvent, two strands of the core material were placed in a polyethylene tube of 0.125 inch outside diameter and 0.060 inch inside diameter. This fuse had a core load of 0.38 gram per foot.

**Trademark for hydrophobic silica aerogel

EXAMPLE 3

A fuse was prepared as in Example 2, utilizing 72.23 percent potassium perchlorate, 17.13 percent calcium silicide (200 mesh) and 10.64 percent microcystalline hexanitrostilbene. The binder consisted of 11.36 grams of Hycar 2671 emulsion and 83 cc. of a 1:1 mixture of ethyl alcohol and acetone. After extrusion of the core material onto glass fiber supporting strands and evaporation of the solvent, the core strands were placed in polyethylene tubing having an outside diameter of 0.125 inch and an inside diameter of 0.050 inch.

Although a secondary high explosive, the hexanitrostilbene was utilized in Example 3 only as an ignition aid and not as a high explosive.

EXAMPLE 4

A fuse was prepared as in Example 1, with the following changes: three strands of ignition material were coated with a fine powder mixture comprising 34% potassium perchlorate, 34% ammonium perchlorate, 32% flake aluminum, and 1% Silanox. Excess coating powder was removed, leaving a tightly adherent thin layer of 7 milligrams per foot weight. The three coated strands were then placed in a tube of poly (vinylidene flouride), 0.120 inch outside diameter and 0.089 inch inside diameter. This ignition fuse has a core load of 0.60 grams per foot. The propagation velocity of the ignition fuse of this example was 1500 meters per second, compared to a velocity of 1000 meters per second with the fuse of Example 1.

Fuses made in accordance with the foregoing examples can be ignited in a number of ways, including a percussion primer, an electric ignitor, or an explosive line or core sufficient to generate a supersonic shock wave in the gas passages of the fuse. In the open air, the core material burns quite slowly, e.g. 6–8 seconds per inch, but when the core is encased in the sheath the ignition reaction is propagated at a velocity on the order of 1,000–1,500 meters per second. the propagation mechanism appears to be a supersonic shock wave which travels along the fuse producing a shock pressure which ignites the core. At a pressure of 760 mm Hg and a temperature of 0° C., 1 gram of the fuse core of Example 1 produces about 1,800 calories and 325 cc. gas. As the reaction travels down the fuse, the sheath is shattered, thereby projecting small, incandescent particles of reaction products radially along the path of the fuse. The flash from the fuse will ignite numerous materials such as black powder, double and single base smokeless powder, boron-potassium nitrate pellets, molybdenum delay compositions and perchlorate-binder compositions.

Ignition fuses prepared in accordance with the foregoing examples have been found to be extremely stable with regard to temperature, impact sensitivity, and sensitivity to electric spark. The fuse will ignite and propagate over a temperature range on the order of −40° F. to +240° F., and the fuse has been stored for 24 hours at 240° F. without affecting its ability to propagate the ignition reaction. In order to test the impact sensitivity of the fuse of Example 1, strands removed from it were impacted between brass and hardened steel surfaces under radial confinement. The 50 percent fire point under these conditions was found to be 7.3 Kg×20 centimeters drop. Samples which fired showed rapid burning without detonation. A constant stream of low-amperage 10,000 volt sparks passed along a strand of the fuse for 15 seconds failed to ignite the strand.

In order to test the brisance characteristics of the fuse, a length of the fuse was taped to an unsupported 0.040 inch sheet of soft aluminum and ignited. There was no visible deformation of the sheet.

The fuse also provides excellent results from the standpoint of toxicity. The gas produced by the fuse of Example 1, for example, consists essentially of water vapor, nitrogen, carbon dioxide and hydrogen chloride. The solid products produced by this fuse include potassium chloride and aluminum oxide.

Figure 2:
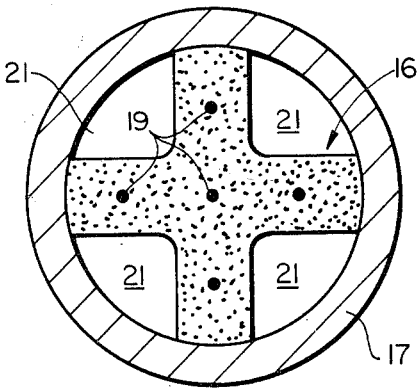

In the embodiment of FIG. 2, core 16 comprises a single cruciform strand, with gas channels 21 formed between the four arms of the core and the inner wall of sheath 17.

Figure 3:
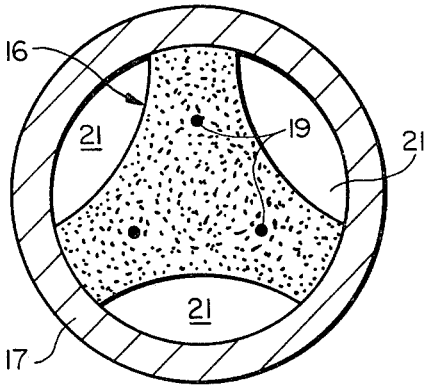

In the embodiment of FIG. 3, core 16 comprises a single triform strand, with gas channels 21 formed between the three arms of the core and the inner wall of sheath 17.

Figure 4:
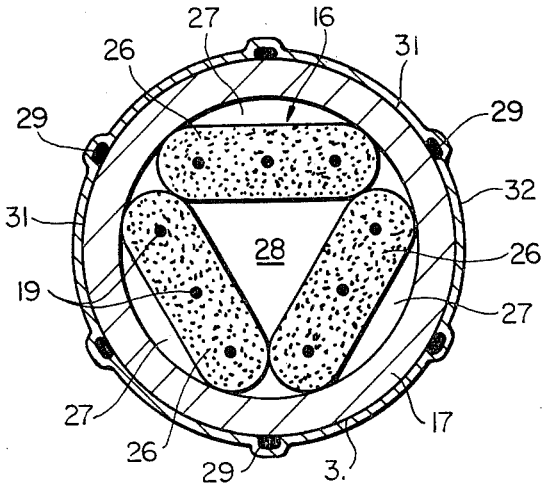

In the embodiment of FIG. 4, core 16 comprises three strands 26 of generally oval cross-section, with gas channels 27 formed between the core strands and the inner wall of sheath 17 and a central gas channel 28 formed between the strands. Reinforcing strands 29 are woven or wrapped about the outer surface of sheath 17 and spaced apart to leave unreinforced areas of the sheath between the strands. A protective coating 32 of polymeric material encases the sheath and reinforcing strands. The reinforcing strands are fabricated of a material of relatively high tensile strength, such as fiberglass or metal wire, and the strands serve to distribute the effect of the reaction in rupturing the sheath. If desired, a coating similar to layer 23 can be applied to the inner surface of the sheath in this embodiment.

Figure 5:
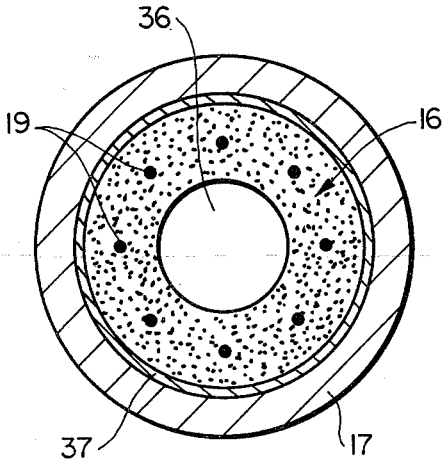

In the embodiment of FIG. 5, core 16 comprises a single strand of annular cross-section, with a central gas channel 36 formed within a core. A layer of thermally insulative material 37 is provided between the outer surface of the core and the inner wall of sheath 17.

Figure 6:
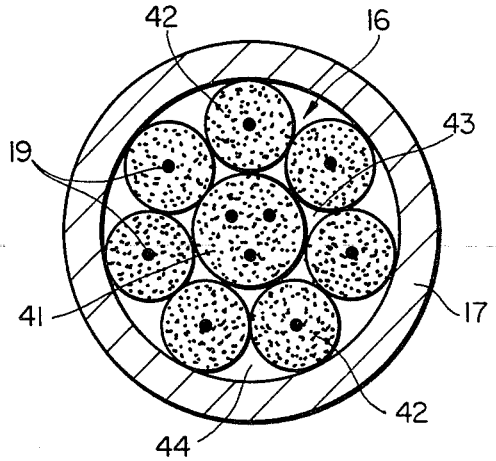

In the embodiment of FIG. 6, core 16 comprises a central strand 41 and seven surrounding strands 42. Inner gas channels 43 are formed between strands 41 and 42, and outer gas channels 44 are formed between strands 42 and the inner wall of sheath 17. If desired, central strand 41 can be fabricated of a different type of ignitive material than the remaining strands.

Figure 7:
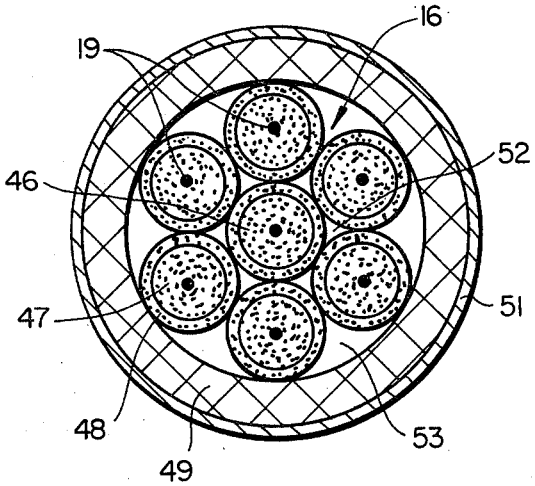

In the embodiment of FIG. 7, core 16 comprises a central strand 46 and six surrounding strands 47. Each of the strands includes an outer coating 48 of a material which is more readily ignitable than the remainder of the strand. If desired, a tightly adherent layer of fine particles (similar to layer 23) can be applied to the outer surface of coating 48 on each of the strands. The core is encased within a sheath 49 comprising interwoven polymeric, ceramic, glass or metal fibers impregnated wtih an ignitive material. Sheath 49 is covered by a protective outer coating 51. In this embodiment, inner gas channels 52 are formed between strands 46 and 47, and outer gas channels 53 are formed between strands 47 and the inner wall of sheath 49.

Figure 8:
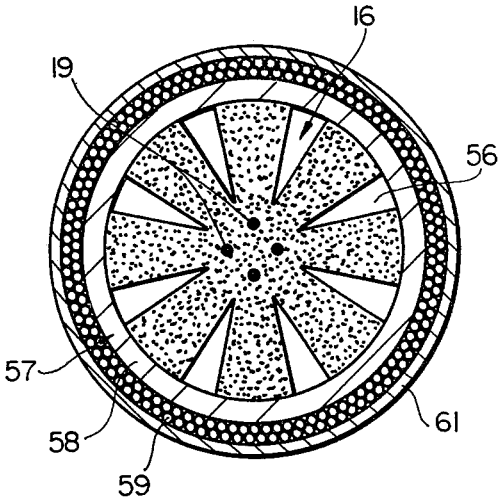

In the embodiment of FIG. 8, core 16 comprises a single radially slotted strand of octaform cross-section. Gas channels 56 are formed in the slots between the eight arms of the core. The core is encased within a sheath 57 comprising an inner layer 58 of polymeric material, intermediate layers 59 of glass fiber wound in oppositely spiralling directions, and an outer protective layer 61 which can also impregnate layers 59, if desired.

Figure 9:
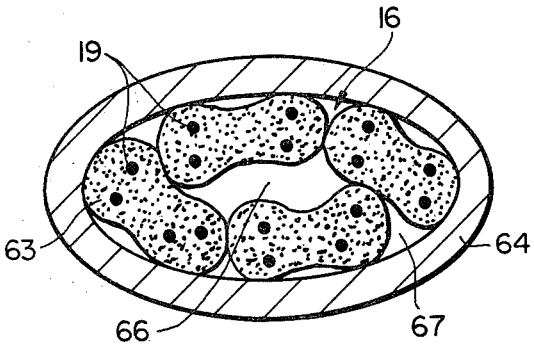

In the embodiment of FIG. 9, core 16 comprises four strands 63 of generally bifoliate cross-section encased within an oval sheath 64. An inner gas channel 66 is formed between the strands, and an outer gas channel 67 is formed betwen the strands and the inner wall of sheath 64.

Figure 10:
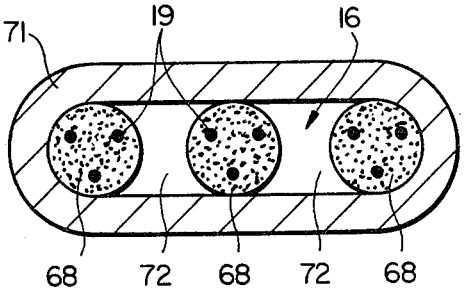

In the embodiment of FIG. 10, core 16 comprises three strands 68 of generally circular cross-section encased within a flattened oval sheath 71. The strands are disposed side by side, and gas channels 72 are formed between adjacent ones of the strands.

Except as otherwise noted above, the ignitive cores and the sheaths of the embodiments of FIGS. 2–10 can be fabricated of the same materials as the core and sheath of FIG. 1. The embodiments of FIGS. 2–10 can be employed to provide a propulsive action as well as ignitive action. In the embodiment of FIG. 10, for example, gas pressure generated by the reacting strands causes flattened sheath 71 to assume an essentially cylindrical shape before rupture. Bodies in contact with the flattened sides of 71 will be projected outwardly, as well as ignited.

The invention has a number of important features and advantages. It provides a non-explosive ignition fuse which will propagate an ignitive reaction very rapidly and is less hazardous to manufacture, store and use than ignition fuses of the prior art. The fuse is relatively lightweight and flexible and produces no toxic gases or obstructive debris when ignited.

It is apparent from the foregoing that a new and improved linear ignitor fuse has been provided. While only certain presently preferred embodiments have been described, as will be apparent to those familiar with the art, certain changes and modifications can be made without departing from the scope of the invention as defined by the following claims.

What is claimed is:

1. In an ignition fuse: an elongated core of ignitive, non-detonative material comprising a mixture of particulate fuel having a high heat of combusion and an oxidant, an imperforate frangible sheath encasing the core, and a longitudinally extending gas channel adjacent to the ignitive material of the core for supporting an ignitive reaction which travels along the fuse at a supersonic rate, shattering the sheath and spewing incandescent reaction products from the fuse in a generally radial direction.

2. The fuse of claim 1 wherein the particulate fuel comprises powdered aluminum.

3. The fuse of claim 1 wherein the sheath is formed of a material selected from the group consisting of plastic, metal, ceramic, a composite material or combinations thereof.

4. The fuse of claim 1 wherein the gas channel is formed between the core and the sheath.

5. The fuse of claim 1 wherein the gas channel is formed within the core.

6. The fuse of claim 1 wherein the core comprises a plurality of longitudinally extending strands coated with the ignitive material.

7. The fuse of claim 1 further including a layer of thermally insulative material between the core and the sheath.

8. The fuse of claim 1 further including a plurality of spaced apart reinforcing strands wrapped about the sheath with unreinforced areas of sheath between the strands.

9. In a linear ignition fuse: an elongated frangible tubular sheath, a core within the sheath comprising a longitudinally extending strand coated with a non-explosive ignitive material having a high heat of combusion, and a longitudinally extending gas channel adjacent to the ignitive material for supporting an ignitive reaction which travels along the fuse at a supersonic rate, shattering the sheath and spewing ineandescent reaction products from the fuse in a generally radial direction.

10. The fuse of claim 9 wherein the ignitive material comprises a mixture of powdered aluminum and an oxidant.

11. The fuse of claim 9 further including a layer of thermally insulative material between the core and the sheath.

12. The fuse of claim 9 further including a plurality of spaced apart reinforcing strands wrapped about the sheath with unreinforced areas of sheath between the strands.

13. The fuse of claim 9 further including a layer of fine particulate material within the sheath having a lower temperature of exothermic decomposition than the material with which the strand is coated.

* * * * *